US005192336A

United States Patent [19]

Grewal

[11] Patent Number: 5,192,336

[45] Date of Patent: Mar. 9, 1993

[54] ANTI-FOAM DIESEL FUEL

[75] Inventor: Rupinder S. Grewal, Sugar Land, Tex.

[73] Assignee: Nalco Chemical Company, Naperville, Ill.

[21] Appl. No.: 802,157

[22] Filed: Dec. 4, 1991

[51] Int. Cl.[5] ..... C104 5/00

[52] U.S. Cl. ..... 44/418; 44/384; 44/412; 44/419

[58] Field of Search ..... 44/384, 412, 418, 419

[56] References Cited

U.S. PATENT DOCUMENTS

| | | | |
|---|---|---|---|
| 3,251,853 | 5/1966 | Hoke | 44/419 |
| 3,296,133 | 1/1967 | Ratner et al. | 44/419 |
| 3,405,064 | 10/1968 | Miller | 44/419 |
| 3,429,674 | 2/1969 | Hoke | 44/419 |
| 4,737,159 | 4/1988 | Phillips | 44/419 |
| 4,808,196 | 2/1989 | Horodysky | 44/419 |
| 4,867,752 | 9/1989 | Braid et al. | 44/418 |

*Primary Examiner*—Prince Willis, Jr.
*Assistant Examiner*—J. Silbermann
*Attorney, Agent, or Firm*—Robert A. Miller; Joseph B. Barrett

[57] ABSTRACT

The present invention provides a method and composition for preventing or reducing foaming in a hydrocarbon fuel. One aspect of the invention provides a hydrocarbon fuel composition including from 0.1 to 500 ppm of a bis amide as an anti-foam agent.

2 Claims, No Drawings

ANTI-FOAM DIESEL FUEL

BACKGROUND OF THE INVENTION

1. Field of the Invention

The invention is generally related to diesel fuel technology, and, more particularly, to anti-foaming agents for diesel fuel.

2. Description of the Prior Art

Silicone-containing anti-foams ("silicone anti-foams") are a integral part of diesel packages in Europe. However, there is a great demand for an non-silicone anti-foam product since several problems are associated with silicones. For example, silicone anti-foams separate from the diesel fuel package due to poor solubility. This causes inconsistent fuel and anti-foam performance. Furthermore, silicone anti-foams contribute to the dispersion of sediments (rust, water, etc.) into the diesel fuel. This may increase emissions and cause damage to the engine. Additionally, there is some concern that the silicone anti-foams themselves contributes to engine deposits and emissions. Lastly, silicones lose there effectiveness as an anti-foam after the treated diesel fuel package has been stored for just a few days unless a high dosage is charged.

SUMMARY OF THE INVENTION

The invention provides a hydrocarbon fuel composition including from 0.1 to 500 ppm of a bis amide. Preferably, the hydrocarbon fuel composition of the invention includes at least one bis amide selected from the group consisting of an ethylene bis stearamide, an ethylene bis oleamide, an ethylene bis lauramide, an ethylene bis palmitamide, and an ethylene bis myristamide. According to one preferred embodiment, the hydrocarbon fuel is a diesel fuel and includes from 1 to 50 ppm of the bis amide.

Another aspect of the invention provides a method for defoaming a hydrocarbon fuel. The method including the step of adding from 0.1 to 500 ppm of a bis amide to the hydrocarbon fuel. The bis amide is at least one bis amide selected from the group consisting of an ethylene bis stearamide, an ethylene bis oleamide, an ethylene bis lauramide, an ethylene bis palmitamide, and an ethylene bis myristamide. According to one preferred embodiment, the hydrocarbon fuel is diesel fuel and the bis amide is added to the hydrocarbon fuel in a dosage of 1 to 50 ppm.

DESCRIPTION OF THE PREFERRED EMBODIMENTS

The present invention provides bis amide hydrocarbon fuel additives which function as anti-foams. The anti-foam compositions of the invention are preferably added to diesel, gasoline, kerosene or other hydrocarbon-based fuel to prevent or reduce foaming. Tests of the invention demonstrate that bis amides are effective anti-foams which remain potent in the diesel fuel for several months. The bis amides of the invention provide several advantages over silicone-based anti-foams. As discussed above, there is a great demand for a non-silicone anti-foam for diesel fuel in Europe. The anti-foams of the invention contain only carbon, hydrogen, nitrogen and oxygen. Therefore, the bis amides of the invention would not contribute to the dispersion of sediments into the diesel fuel. Furthermore, unlike silicone-containing anti-foams, bis amide anti-foams may not contribute to engine deposits or emissions since it is all combustible. Lastly, bis amides remain effective as an anti-foam even after the treated diesel fuel has been stored for more than two months.

According to one preferred embodiment of the invention, a hot solution containing the bis amide ethylene bis stearamide in an aromatic solvent is added to a typical diesel fuel at a dosage of from 0.1 to about 500 ppm. More preferably, the anti-foam is added at a dosage of from 1 to 50 ppm, and, most preferably, the anti-foam is added at a dosage of from about 2 to 30 ppm.

The bis amide anti-foams of the invention were tested by performing shake tests. Tests of the invention demonstrate that in diesel fuel packages including bis amide anti-foams, there was either no foam formation or that it disappeared in less than 10 seconds after shaking. In contrast, the diesel fuel containing no anti-foam took about 45 seconds for the foam to disappear. Diesel fuel packages including bis amide anti-foams were found to be effective as anti-foams in the diesel fuel even after the treated diesel fuel had been stored for more than two months.

A number of bis amides useful in the practice of the invention have been synthesized using different diamines and different acids. The most preferred bis amide anti-foam is the commercially available ethylene bis stearamide (defoamer grade). This bis amide performed the best during anti-foam evaluations. A dispersion of the bis amide can be prepared in an appropriate solvent or in the disel detergent package. The dispersion is preferably added hot or to a hot diesel fuel or is preferably in a liquid form before adding to the ambient diesel fuel with constant stirring.

The following examples are presented to describe preferred embodiments and utilities of the invention and are not meant to limit the invention unless otherwise stated in the claims appended hereto.

EXAMPLE 1

In order to demonstrate the surprising and unexpected anti-foam property of bis amides in diesel fuel, a total of 100 anti-foam samples were tested using a bottle shake test in a German diesel fuel at a dosage of 2 and 30 ppm. All of these samples are known anti-foams in other applications, but not in diesel fuels or other hydrocarbon fuels. The samples tested are listed in Table 1. Of all the samples tested, only the two bis amides tested, ethylene bis stearamide (EBS) and ethylene bis oleamide (EBO), were found to be effective anti-foams in diesel fuel. Moreover, EBS was found to be effective even after the treated diesel fuel had been sitting for more than two months. With the exception of silicone-based anti-foams, the bis amide materials were the samples that were found to be most effective out of all the samples tested. EBS also performed very well in two other diesel fuels. The ethylene bis stearamide material was supplied by Nalco Chemical Company, Akzo Chemicals and Witco. Ethylene bis oleamide (Oleic acid: $C_{18}$; double bond between $C_9$ and $C_{10}$), although it functioned as a defoamer in the diesel package, did not work as well as EBS.

TABLE 1

| Sample name | Manufacturer |
|---|---|
| Surfynol DF-34 Defoamer | Air Products |
| Surfynol DF-58 Defoamer | Air Products |
| Surfynol DF-75 Defoamer | Air Products |
| Surfynol D-101 Defoamer | Air Products |
| Surfynol D-110 Defoamer | Air Products |

TABLE 1-continued

| Sample name | Manufacturer |
|---|---|
| Surfynol DF-110D Defoamer | Air Products |
| Surfynol DF-110L Defoamer | Air Products |
| Surfynol DF-110S Defoamer | Air Products |
| Surfynol D-201 Defoamer | Air Products |
| Armowax EBS-D | Akzo Chemical Co. |
| Alkaterge-E | Angus |
| Alkaterge-T | Angus |
| NS-31F | Arol Chemical Products Co. |
| Central 3F-UB lecithin | Central Soya |
| Centrophase C lecithin | Central Soya |
| Centrophase NV lecithin | Central Soya |
| Defoamer 703 conc | Chemurgy |
| Nomofome NS | Chemurgy |
| Intrafomil AK | Crompton and Knowles |
| Intrafomil 118 | Crompton and Knowles |
| Myvacet 9-45 | Eastman Chemicals |
| ECCO Defoamer NS-07 | Eastern Color and Chemicals |
| D-Limonene | Florida Chemical Co. |
| HL-27 | Harcros |
| HL-40 | Harcros |
| Emsorb 2515-SML | Henkel |
| Trycol 6720-LF1 | Henkel |
| Trycol 6985-DNP-8 | Henkel |
| Foamaster A | Henkel |
| Foamaster DF-269S | Henkel |
| Foamaster NS | Henkel |
| Foamknocker | Ideas Inc. |
| Foamknocker M-433 | Ideas Inc. |
| Acconon E | Karlshamns |
| FC-170C | 3M |
| FC-171 | 3M |
| Michel XO-160 | M. Michel and Co. |
| PC 1244 | Monsanto |
| PC 1344 | Monsanto |
| (EBS) | Nalco |
| N-ethanol Stearamide | Nalco |
| N-131 | Nalco |
| N-131-DR | Nalco |
| N-2305 | Nalco |
| N-2309 | Nalco |
| N-2314 | Nalco |
| N-4701 | Nalco |
| N-4903 | Nalco |
| N-5761 | Nalco |
| N-5770 | Nalco |
| N-5777 | Nalco |
| N-7450 | Nalco |
| N-7452 | Nalco |
| N-7460 | Nalco |
| N-7569 | Nalco |
| N-8610 | Nalco |
| N-8615 | Nalco |
| PR-471 | Nalco |
| PR-475 | Nalco |
| 88BT-062 | Nalco |
| 88RT-096 | Nalco |
| Mazu DF 160CA | PPG/Mazer |
| Mazu DF 197 | PPG/Mazer |

TABLE 1-continued

| Sample name | Manufacturer |
|---|---|
| Mazu DF 255 | PPG/Mazer |
| Maztreat 246 | PPG/Mazer |
| Anti-foam 204 | Sigma |
| Anti-foam base 263 | Soluol |
| Anti-foam GQ | Soluol |
| Anti-foam Q compd. | Soluol |
| Foam Ban G/O | Ultra Additives |
| Foam Ban NA | Ultra Additives |
| Foam Ban XRM-2461F | Ultra Additives |
| Foam Ban CO | Ultra Additives |
| Kemamide W-20 (ethylene bis oleamide) | Witco (Humko) |
| Kemamide W-40 DF (EBS) | Witco (Humko) |
| Bubble breaker 3056A | Witco |
| Bubble breaker 3295 | Witco |

EXAMPLE 2

Five different bis amides were synthesized from the appropriate reagents listed-below in Table 2. Compared to controls, the bis amides listed in Table 2 all were effective as anti-foams in the diesel fuel packages described in Example 1.

TABLE 2

| Bis amide | Acid | Amine |
|---|---|---|
| A | stearic acid ($C_{18}$) | 1,3-diaminopropane |
| B | lauric acid ($C_{12}$) | ethylenediamine |
| C | palmitic acid ($C_{16}$) | ethylenediamine |
| D | myristic acid ($C_{14}$) | ethylenediamine |
| E | stearic acid | ethylenediamine |

Ethylene bis stearamide appeared to be the most effective anti-foam evaluated.

Changes can be made in the composition, operation and arrangement of the method of the present invention described herein without departing from the concept and scope of the invention as defined in the following claims:

I claim:

1. A hydrocarbon fuel composition, wherein said hydrocarbon fuel is a diesel fuel including from 1–50 ppm of a bis amide selected from the group consisting of an ethylene bis stearamide, an ethylene bis oleamide, an ethylene bis lauramide, an ethylene bis palmitamide, and an ethylene bis myristamide.

2. A method for defoaming a hydrocarbon fuel, wherein said hydrocarbon fuel is a diesel fuel, the method including the step of adding from 1–50 ppm of a bis amide selected from the group consisting of an ethylene bis stearamide, an ethylene bis oleamide, an ethylene bis lauramide, an ethylene bis palmitamide, and an ethylene bis myristamide.

* * * * *